US009764588B2

(12) United States Patent
Ballot et al.

(10) Patent No.: US 9,764,588 B2
(45) Date of Patent: Sep. 19, 2017

(54) LIQUID APPLICATOR DEVICE

(71) Applicant: FLOCON, Inc, Cary, IL (US)

(72) Inventors: Stephan M Ballot, Barrington Hills, IL (US); Robert D Forschler, Crystal Lake, IL (US)

(73) Assignee: Flocon Inc., Woodstock, IL (US)

( * ) Notice: Subject to any disclaimer, the term of this patent is extended or adjusted under 35 U.S.C. 154(b) by 149 days.

(21) Appl. No.: 14/639,486

(22) Filed: Mar. 5, 2015

(65) Prior Publication Data

US 2015/0251484 A1 Sep. 10, 2015

Related U.S. Application Data

(60) Provisional application No. 61/948,787, filed on Mar. 6, 2014.

(51) Int. Cl.

| | |
|---|---|
| ***B43K 8/04*** | (2006.01) |
| ***B43K 8/02*** | (2006.01) |
| ***B43K 5/18*** | (2006.01) |
| ***A46B 11/00*** | (2006.01) |
| ***B43K 8/00*** | (2006.01) |

(52) U.S. Cl.

CPC ..... *B43K 8/04* (2013.01); *A46B 11/0079* (2013.01); *B43K 5/1845* (2013.01); *B43K 8/003* (2013.01); *B43K 8/02* (2013.01); *B43K 8/024* (2013.01)

(58) Field of Classification Search

CPC combination set(s) only.

See application file for complete search history.

(56) References Cited

U.S. PATENT DOCUMENTS

| | | | | |
|---|---|---|---|---|
| 1,857,467 A | | 5/1932 | Marsh | |
| 2,024,413 A | | 12/1935 | Witt | |
| 2,104,638 A | | 1/1938 | Cuthbert | |
| 2,210,662 A | | 8/1940 | Garvey | |
| 2,330,053 A | | 9/1943 | Herb | |
| 2,611,916 A | | 9/1952 | Prokop et al. | |
| 2,716,250 A | | 8/1955 | Deakers | |
| 3,468,611 A | | 9/1969 | Ward | |
| 3,484,027 A | | 12/1969 | Micallef | |
| 3,640,631 A | * | 2/1972 | Sotir | B43K 5/1845 401/206 |
| 4,496,258 A | * | 1/1985 | Tanaka | B43K 5/1845 401/198 |
| 4,569,612 A | | 2/1986 | Schwartzman et al. | |
| 4,685,820 A | | 8/1987 | Kremer et al. | |

(Continued)

FOREIGN PATENT DOCUMENTS

NL 1016153 3/2002

*Primary Examiner* — David Walczak

(74) *Attorney, Agent, or Firm* — Frijouf, Rust & Pyle, P.A.

(57) ABSTRACT

A liquid applicator device for dispensing an applicator liquid from an applicator liquid container. The liquid applicator device comprises a closure having an internal passageway for sealing with the applicator liquid container. A dispensing mechanism is disposed in the internal passageway of the closure. An applicator located in the passageway engaging with the valve element for enabling a depression of the applicator to displace the valve element from the sealing surface to enable the flow of the applicator liquid from the liquid container into the applicator. A capture extends from the valve element for grasping the applicator for inhibiting removal of the applicator from the passageway.

14 Claims, 9 Drawing Sheets

(56) References Cited

U.S. PATENT DOCUMENTS

| | | | | | |
|---|---|---|---|---|---|
| 4,761,090 | A | | 8/1988 | Goh | |
| 4,792,252 | A | | 12/1988 | Kremer et al. | |
| 4,812,071 | A | | 3/1989 | Batra et al. | |
| 4,848,947 | A | | 7/1989 | Kremer et al. | |
| 4,913,175 | A | | 4/1990 | Yokosuka et al. | |
| 4,976,564 | A | * | 12/1990 | Fukuoka | A45D 34/042 401/176 |
| 4,984,923 | A | | 1/1991 | Ota | |
| 4,993,859 | A | | 2/1991 | Assad et al. | |
| 5,035,524 | A | * | 7/1991 | Sakurai | A45D 34/042 401/151 |
| 5,362,168 | A | * | 11/1994 | Abe | B43K 5/1845 401/198 |
| 5,899,624 | A | | 5/1999 | Thompson | |
| 6,010,263 | A | | 1/2000 | White et al. | |
| 6,513,681 | B2 | | 2/2003 | Gross et al. | |
| 6,634,821 | B2 | | 10/2003 | Gueret | |
| 6,641,320 | B1 | | 11/2003 | Ballot et al. | |
| 6,773,193 | B2 | | 8/2004 | Delage | |
| 6,817,801 | B1 | | 11/2004 | Colburn et al. | |
| 6,817,802 | B2 | | 11/2004 | Nishitani et al. | |
| 6,883,995 | B1 | | 4/2005 | Gueret | |
| 6,935,536 | B2 | | 8/2005 | Tardif | |
| 6,945,722 | B2 | | 9/2005 | Colburn et al. | |
| 7,101,105 | B2 | | 9/2006 | Reggiani | |
| 7,114,871 | B2 | | 10/2006 | Thiebaut | |
| 7,563,046 | B2 | | 7/2009 | Patel | |
| 2002/0021933 | A1 | | 2/2002 | Knieriemen | |
| 2005/0141951 | A1 | | 6/2005 | Gueret | |
| 2006/0083577 | A1 | | 4/2006 | Gueret | |
| 2009/0103968 | A1 | | 4/2009 | Ballot | |

* cited by examiner

LIQUID APPLICATOR DEVICE

CROSS-REFERENCE TO RELATED APPLICATIONS

This application claims benefit of U.S. Patent Provisional application No. 61/948,787 filed Mar. 6, 2014. All subject matter set forth in provisional application No. 61/948,787 filed Mar. 6, 2014 is hereby incorporated by reference into the present application as if fully set forth herein.

BACKGROUND OF THE INVENTION

Field of the Invention

This invention relates to the dispensing of liquids and more particularly, this invention relates to an improved liquid applicator device for marking, writing or dispensing a liquid onto a surface.

Background of the Invention

Various types of liquid applicator devices have been devised for dispensing a liquid. Some of these liquid applicator devices were used for dispensing an applicator liquid for writing with ink, dye or paint. Among such devices were fountain pens, ball point pens, felt tip pens as well as other types of liquid applicator devices and the like.

These liquid applicator devices of the prior art have received wide acceptance due in great measure to the convenience of the device. Furthermore, these liquid applicator devices of the prior art had the ability to retain a large quantity of applicator liquid and the ability to supply additional applicator liquid from a liquid container to an applicator tip at the discretion of the user. In addition, the liquid applicator devices were not limited to the dispensing of only writing liquid such as paints, dyes and the like but are capable of dispensing a large variety of applicator liquids including chemicals, perfumes, lubricants and the like.

Continuing efforts have been made in the past to improve the design of the liquid applicator devices. The improved design of the liquid applicator devices have concentrated on the liquid dispensing mechanism and for improving the communication of the liquid from the liquid container to the applicator tip for dispensing the applicator liquid onto a surface. In one example of a liquid applicator device, an applicator liquid flows into a fiber applicator tip only when the liquid applicator device is held upside down and the fiber applicator tip is depressed by a surface to be coated by the applicator liquid.

U.S. Pat. No. 1,857,467 to Marsh discloses a fountain marker comprising a main reservoir adapted to contain fluid with an end wall for the reservoir having an opening. An auxiliary reservoir is arranged to receive fluid through the opening with a valve opening and closing the discharge outlet. A stem connected to the valve extends through the opening. The fluid is admitted from the main reservoir to the auxiliary reservoir when the valve is closed and is prevented from flowing from the main reservoir to the auxiliary reservoir when the valve is in an open position. A spring holds the valve closed with an applicator tip attached to the valve.

U.S. Pat. No. 2,024,413 to Witt discloses a fountain brush comprising an elongated hollow handle forming a liquid reservoir. A cap is secured to the forward end of the handle having an elongated frusto-conical valve seat and a closure cap on the opposite end of the handle. An elongated conical valve is received in the valve seat. An inwardly projecting stem is formed on the rear end of the valve. The forward end of the valve carries an outwardly projecting shank. A cross-head on the stem having an end is slidably engaged with the inner face of the hollow handle. A contractile coil spring is disposed about the stem having one end anchored to the stem and the other end being anchored in place between the forward cap and handle. A brush-head on the shank and a conical deflector formed on the brush-head are arranged in facing relation to the valve for receiving liquid.

U.S. Pat. No. 2,210,662 to Garvey discloses a writing instrument comprising a reservoir for the writing fluid and a valve tiltable in different directions to control the discharge of fluid from the reservoir. A tiltable tip holder is united with and extends from the tiltable valve with the tiltable tip holder having an internal screw thread. A writing tip is made of a yieldable absorbent material and is screwed into the internal thread to project from the lower end of the tip holder. The writing tip is adjustable longitudinally on the screw thread in response to rotary movements of the tip independently of the tip holder. A means limits the rotary movements of the tip holder and includes a tiltable abutment carried by and tiltable with the united valve and tip holder and a fixed abutment co-operating with the tiltable abutment.

U.S. Pat. No. 2,330,053 to Herb discloses a fountain applicator comprising a fluid containing reservoir and a marking nib and means operable by pressure on the nib in excess of that required for marking therewith for forcing fluid from the reservoir to the nib.

U.S. Pat. No. 3,468,611 to Ward discloses a liquid applicator having a tubular member of flexible side wall construction. A porous applicator nib and valve means control the flow of liquid from the tubular member to the applicator nib.

U.S. Pat. No. 3,484,027 to Micallef discloses a valve closure for dispensing liquids from a container comprising a cap member attached to one end of the container having a centrally located boss member extending towards the interior of the container. An aperture in the boss member and a flange member is spaced from the boss member and adapted to engage the inside of the mouth of the container in sealing relationship. A valve member including a valve stem is mounted for rotation in the boss member. The valve stem has communicating radial and axial openings with an opening in the boss member being adapted to communicate with the radial opening thereby permitting selective opening and closing of the valve closure. A radially resilient extension extends from one end of the valve stem. The extension has portions which are radially compressible to permit assembly of the valve stem member and the boss member. The radially extending portions are adapted to cooperate with the boss member to prevent disassembly of the valve and the boss member, wherein the resilient extension has a semi-circular shape.

U.S. Pat. No. 4,685,820 to Kremer et al. discloses an improved applicator device for applying an applicator material such as a liquid or a flowable solid to a surface. The device comprises a material container and a surface applicator for applying the applicator material to the surface. A valve is interposed between the material container and the surface applicator to permit the flow of applicator material to the surface applicator when the valve is in an open position and to inhibit the flow of applicator material to the surface applicator when the valve is in a closed position. The valve includes a valve closure having an internal closure cavity with a first end being connected to the material container and with a second end defining a surface applicator opening therein. The valve element has a distal end portion that extends through the applicator opening of the valve closure when the valve element is biased into the closed position. The surface applicator comprises the distal end portion of the valve element cooperating with the applicator opening when the distal end portion of the valve element is pressed against the surface thereby forming an annular opening for the flow of the applicator material to apply and disperse the applicator material on the surface. U.S. Pat. No. 4,685,820 to Kremer et al. provided a significant step forward in the art of liquid applicator devices.

U.S. Pat. No. 4,792,252 to Kremer et al. discloses a liquid applicator device for applying a liquid such as paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

U.S. Pat. No. 4,976,564 to Fukuoka et al. discloses an implement for applying a liquid comprising a container having an opening at a front end and a front tube attached to the container forward end. A hollow accommodating member has a chamber in an interior and formed with a rearward communication hole and a forward communication hole for holding the chamber in communication with the interior of the container and the interior of the front tube respectively. A liquid feed member is accommodated in the chamber and is movable axially thereof. A biased end valve is disposed inside the front tube to provide a liquid retaining portion inside the front tube around the end valve for closing the forward end opening of the front tube. An applicator having a capillary action extends through the forward end opening of the front tube and is secured to the front end of the end valve.

U.S. Pat. No. 4,984,923 to Ota discloses an operating member inserted in the middle cylinder to be movable backward and forward in the axial direction. A valve mechanism is provided in the front portion of the middle cylinder to supply the pinpoint with the applied liquid stored in the rear portion of the middle cylinder. The valve mechanism includes a valve seat having a valve hole with a valve spindle being provided with a valve element for opening and closing the valve hole and a stretchable member for moving the valve spindle backward and forward. The stretchable member is elongated and shortened in the axial direction of the middle cylinder as the bent portions are bent less and more, respectively. The operating element at the rear end of the middle cylinder is operated to move the operating member forward to push the bent portions of the bent arms to elongate the stretchable member. The valve spindle is moved backward to open the valve hole to supply the applied liquid to the pinpoint.

U.S. Pat. No. 4,993,859 to Assad et al. discloses a liquid applicator including a valve body for insertion into the neck of a liquid container and defining a duct in the valve body. A resilient web is formed integrally with the valve body and extends transversely across the duct. A valve seat is located on one end of the valve body. A valve member is secured to the resilient web and has a valve biased into engagement with the valve seat at the end of the valve body. A coating member is mounted on the opposite end of the valve body. A valve stem on the valve member is located proximate the coating member for being deflected when the coating member is compressed onto an external surface to thereby unseat the valve and permit liquid to flow through the duct onto the coating member.

U.S. Pat. No. 4,913,175 to Yokosuka et al. discloses a liquid-applying tip assembly in which the liquid-applying member is pushed to operate the valve to allow the liquid to flow to the liquid-applying member. The liquid-applying member is a plastic member which comprises: a plurality of ribs extending radially and axially from an axial core in such a manner as to form a plurality of axial liquid passageways therebetween. A barrier is provided between the valve and the cylinder of the tip assembly, the barrier having a hole whose diameter is slightly larger than the outside diameter of the liquid-applying member to control the flow of liquid.

U.S. Pat. No. 6,513,681 to Gross et al. discloses a spray dispensing closure including a spray plug and a cap cooperating therewith to selectively occlude passages in the spray plug. A spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages extend from a proximal end of the dip tube. A plurality of dip tube ends engage ribs extend from the spray plug. When the container is squeezed and the cap is open, product is conveyed from the dip tube and into the inner passages to be mixed with air from the head space.

U.S. Pat. No. 6,634,821 to Gueret discloses a device and system for applying a product, for example, a cosmetic product. The device includes a first compartment containing the product, and a second compartment in flow communication with the first compartment via at least one supply orifice, with the second compartment having an opening which may be removably closed by a closure element. The second compartment may form a housing for an applicator which is insoluble with respect to the product. The applicator may rest against an elastically compressible porous member that may be in flow communication with the supply orifice.

U.S. Pat. No. 6,773,193 to Delage discloses a device for packaging and applying a substance, in particular a cosmetic or a care product, the device comprising a receptacle for containing the substance. The receptacle is provided at the top with an applicator that is permeable to the substance and that has an inside face fed with the substance coming from the receptacle. In the vicinity of the bottom face of the applicator, the device comprises an element that forms an intermediate reservoir that is in permanent communication with the receptacle and that is suitable for retaining a certain quantity of the substance when the device is turned upside-down from a head-up position and is then returned to the head-up position. The intermediate reservoir-forming element are arranged to enable the substance retained in this way to feed the applicator, at least in certain conditions of use of the device.

U.S. Pat. No. 6,817,801 to Colburn et al. discloses an applicator device for applying treatment fluid to various interior surfaces such as those found in an automobile, which is constructed with an applicator head including a housing having a bottom distribution plate and an applicator pad affixed thereto, and which is configured to complementally and releasably receive an associated fluid container.

U.S. Pat. No. 6,817,802 to Nishitani et al. discloses a writing instrument adapted, responsive to a pressure axially applied to a pen core, to supply ink in an ink chamber to the pen core. The writing instrument includes a valve seat disposed between the ink chamber and the pen core. A valve body is operable to be selectively moved between a close position where the valve body is in contact with the valve seat to isolate the pen core from the ink chamber and an open position where the valve body is spaced apart from the valve seat to communicate the pen core with the ink chamber. A pressing spring biases the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

U.S. Pat. No. 6,945,722 to Colburn et al. discloses a tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

U.S. Pat. No. 7,101,105 to Reggiani discloses a container-applicator for fluid products for cosmetic and pharmaceutical use. An applicator is provided with a spongy-matrix body that is arranged proximate to an opening controlled by a valve element that can be operated from the outside of the container body, the valve element comprising a cap body that can be actuated rotationally in order to pass from a closed position to an open position of the opening and/or vice versa.

U.S. Pat. No. 7,114,871 to Thiebaut discloses a packaging and application device for a product, specifically a cosmetic product. The device includes a receptacle for cleaning the product having a longitudinal axis and a passageway. The receptacle also includes a porous or fibrous applicator element capable of communicating with the product in the receptacle through the passageway. A dispensing element adapted for opening and closing the passageway. The device further contains a dispensing element adapted for opening and closing the passageway and includes a mobile part rotatable about the longitudinal axis between a first position in which the passage is closed and a second position in which the passage is open. The device also includes a closure cap capable of engaging a dispensing element.

U.S. Pat. No. 6,641,320 to ballot et al. disclosed an improvement to U.S. Pat. No. 4,685,820 to Kremer et al. comprising an applicator tip having a recess and a generally toroidal retaining ring disposed in the recess of the applicator tip. The recess cooperates with the retaining ring for preventing removal of the applicator tip from the liquid applicator device.

It is an object of the present invention is to improve upon U.S. Pat. No. 4,685,820 to Kremer et al. and U.S. Pat. No. 4,792,252 to Kremer et al. and U.S. Pat. No. 6,641,320 to Ballot et al. to provide an improved liquid applicator device that inhibits removal of the applicator tip from the liquid applicator device in a different manner.

Another object of the present invention is to provide an improved liquid applicator device that is capable of dispensing a finer amount of an applicator liquid.

Another object of the present invention is to provide an improved liquid applicator device that is simpler in design and more economical to manufacture.

Another object of the present invention is to provide an improved liquid applicator device that has a reduced number of parts.

The foregoing has outlined some of the more pertinent objects of the present invention. These objects should be construed as being merely illustrative of some of the more prominent features and applications of the invention. Many other beneficial results can be obtained by modifying the invention with in the scope of the invention. Accordingly other objects in a full understanding of the invention may be had by referring to the summary of the invention and the detailed description describing the preferred embodiment of the invention.

SUMMARY OF THE INVENTION

The present invention is defined by the appended claims with the specific embodiments shown in the attached drawings. For the purpose of summarizing the invention, the invention comprises a liquid applicator device for dispensing an applicator liquid from an applicator liquid container. The liquid applicator device comprises a closure having an internal passageway for sealing with the applicator liquid container. A valve body is disposed in the internal passageway of the closure. A valve seal has a sealing surface secured to the valve body. A valve element is disposed within the closure. A spring acts between the valve body and the valve element for biasing the valve element into sealing engagement with the sealing surface of the valve seal for inhibiting the flow of the applicator liquid from the applicator liquid container. An applicator is located in the passageway engaging with the valve element for enabling a depression the applicator to displace the valve element from the sealing surface to enable the flow of the applicator liquid from the liquid container into the applicator. A capture extends from the valve element for grasping the applicator for inhibiting removal of the applicator from the passageway.

In one embodiment of the invention, the sealing surface comprises a generally tubular member defining an annular sealing surface at a termination of the generally tubular member. The valve element defines a first and a second end. The valve element has a generally conical surface descending from the first end of the valve element toward the second end of the valve element for forming a sealing engagement with the sealing surface of the valve seal.

The capture comprises a plurality of resilient fingers extending from the valve element for resiliently grasping the applicator. In one example, a groove is defined in the reduced cross-section of the first end of the applicator. Each of the resilient fingers has a hook for resiliently engaging with the groove to inhibit removal of the applicator tip from the valve element.

In another embodiment of the invention, a ferrule partially covers the second end of the applicator for providing mechanical strength to the applicator tip. The ferrule forms a sliding relationship with a terminal orifice of closure.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments maybe modifying for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figures 1, 2:
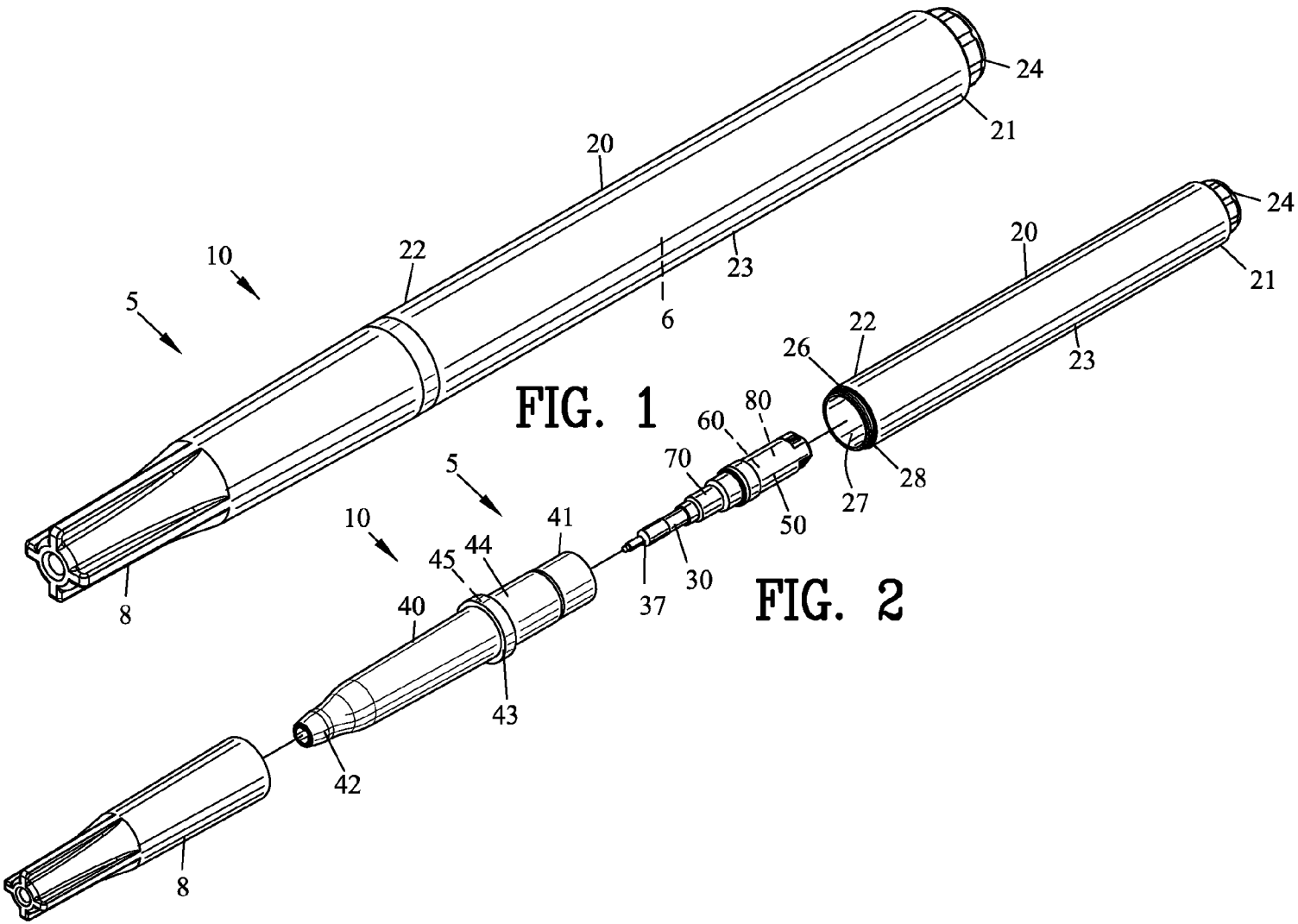
FIG. 1 is an isometric view of a liquid applicator device of the present invention.
FIG. 2 is an exploded view of the liquid applicator device of FIG. 1.
Figure 3:
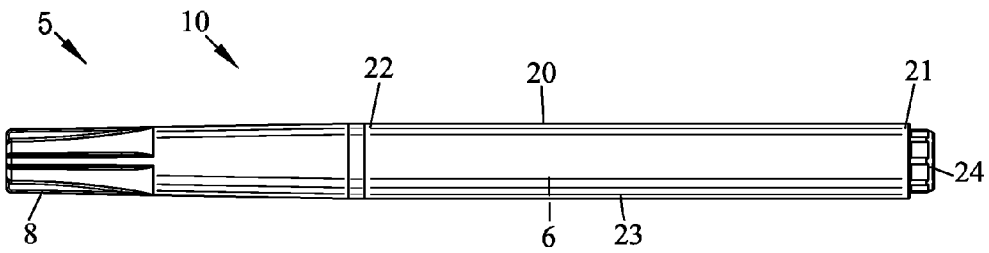
FIG. 3 is a side view of the liquid applicator device of FIG. 1.
Figure 4:
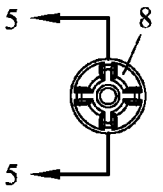
FIG. 4 is an end view of the liquid applicator device of FIG. 3.

FIGS. 1-6 illustrate a liquid applicator device 5 having a dispensing mechanism 10 for dispensing an applicator liquid 6 from a container 20 to an applicator 30. FIGS. 1-5 illustrate a protective overcap 8 for the liquid applicator device 5 to prevent accidental dispensing and provides a seal for the applicator liquid 6. As will be described in greater detail hereinafter, the applicator 30 is used to dispense the applicator liquid 6 from the container 20 onto the surface (not shown) upon the depression of the applicator tip 30 on the surface (not shown).

The container 20 has a first end 21 and a second end 22 with a generally cylindrical sidewall 23. The first end 21 of the container 20 is closed by an end wall or a plug 24. The container 20 may be formed from a polymeric material, a metallic material or the like. The second end 22 of the container 20 defines an annular recess 26 about an opening 27 in the container 20. A container boss 28 extends outwardly from the annular recess 26. Preferably, the container 20 is formed from a polymeric material rendering a resiliency to the annular recess 26 and the container boss 28.

Figures 7, 8:
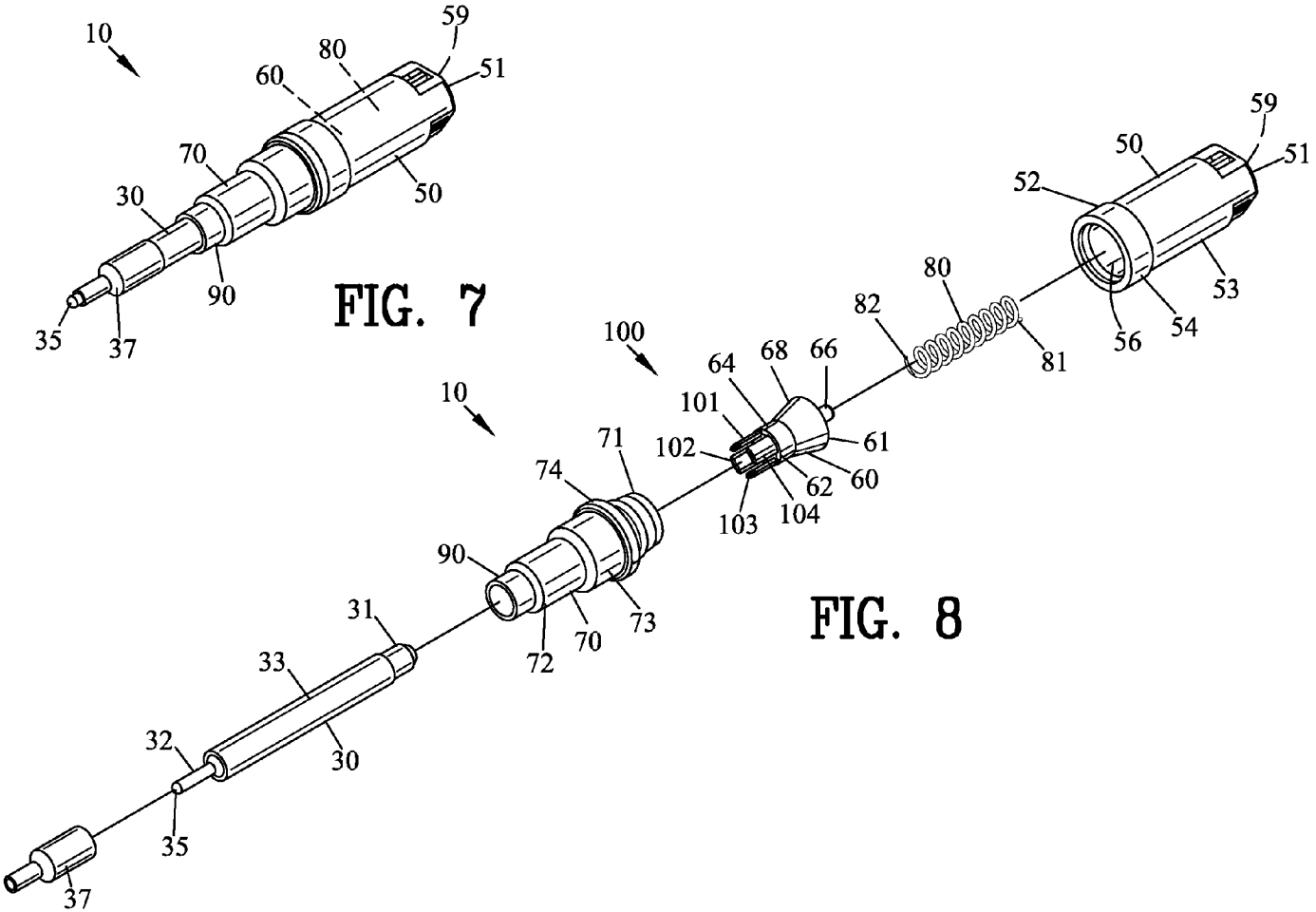
FIG. 7 is an enlarged isometric view of a dispensing mechanism of the liquid applicator device of FIG. 1.
FIG. 8 is an enlarged exploded view of FIG. 7.
Figure 9:
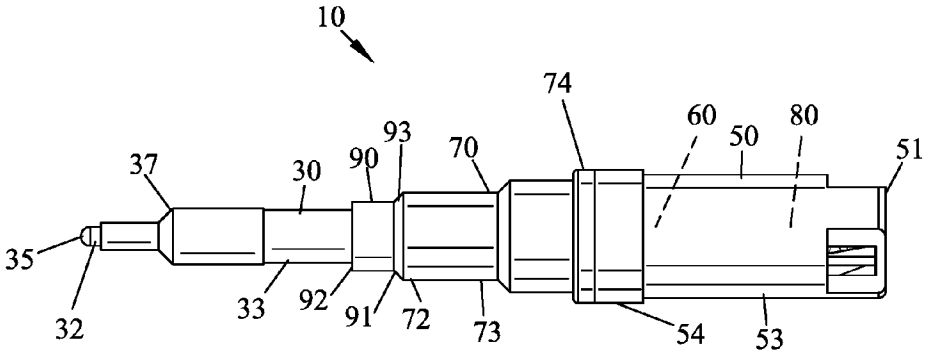
FIG. 9 is a magnified side view of the dispensing mechanism of FIGS. 7 and 8.
Figure 10:
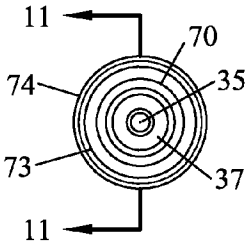
FIG. 10 is an end view of FIG. 9.

As best shown in FIG. 8, the applicator 30 extends between an inner end 31 and an outer end 32. The applicator 30 is a generally cylindrically shaped member defining a cylindrical diameter 33 between the inner end 31 and the outer end 32. The outer end of the applicator 30 defines an applicator tip 35. An optional ferrule 37 is disposed on the outer end 32 of the applicator 30 for adding mechanical strength to the reduced size applicator tip 35. The applicator 30 may formed from a felt fiber, solid or a brush construction. The applicator tip 30 may be rigid or flexible.

In this example of the invention, the applicator 30 is formed of a highly compacted fibrous material such as polyester or other similar material having analogous properties sufficient to hold the original shape when moistened with the applicator liquid 6 but adequate to pass the applicator liquid 6 from the inner end 31 to the outer end of the applicator tip 30 by capillary action. In the alternative, the applicator tip 30 may be a non-porous material with grooves extending longitudinally along an outer surface of the applicator tip 30.

A closure 40 extends between an inner end 41 and an outer end 42. The closure 40 includes an outer shoulder 43 extending radially outward from an outer surface 44 of the closure 40 between the inner end 41 and the outer end 42. The inner end 41 of the closure 40 is dimensioned to be inserted into the second end 22 of the liquid container 20.

Figure 5:
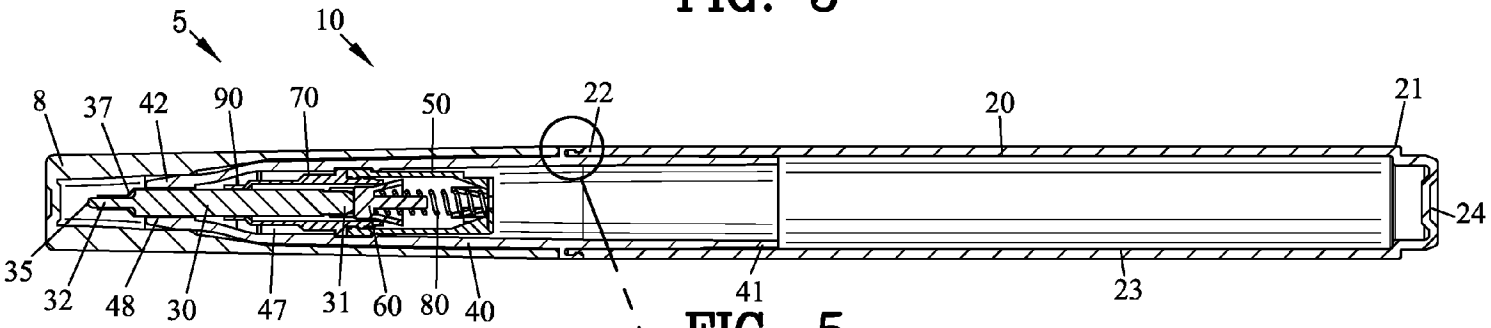
FIG. 5 is an enlarged sectional view along line 5-5 in FIG. 4.
Figure 6:
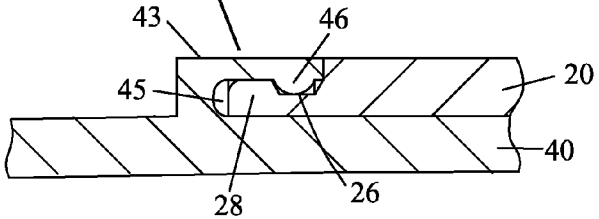
FIG. 6 is a magnified view of a portion of FIG. 5.

FIG. 6 is a magnified view of a portion of FIG. 5. The outer shoulder 43 has an undercut 45 with a closure boss 46 extending inwardly from the undercut 45 toward the outer surface 44 of the closure 40. Preferably, the closure 40 is formed from a polymeric material rendering a resiliency to the outer shoulder 43 and the closure boss 46. When the inner end 41 of the closure 40 is inserted into the second end 22 of the liquid container 20, the annular recess 26 of the container 20 is received within the undercut 45 of the outer shoulder 43 of the closure 40. The container boss 28 and the closure boss 46 resiliently engage one another to lock the closure 40 to the container 20.

The snap fitment of two separate, but cooperating container boss 28 and the closure boss 46 creates an enhanced seal and much higher interlock retention between the container 20 and the closure 40. The cooperating engagement of the container boss 28 and the closure boss 46 also relies on an internal interference of the outer wall of the closure 40 to the inner wall of the container 20. The internal interference of the outer wall of the closure 40 to the inner wall of the container 20 forces the container boss 28 to place a force against the closure boss 46. The container boss 28 becomes trapped by the outer shoulder 43 of the closure 40 and hoop forces are enhanced by displacement caused by interference of fitments to form an enhanced seal and interlocked assembly.

The closure 40 defines an internal passageway 47 extending between the inner end 41 and the outer end 42. The inner end 41 of the closure 40 communicates with the liquid container 20. The outer end 42 of the closure 40 defines a terminal orifice 48 dimensioned to slidably receive the applicator 30. The dispensing mechanism 10 for dispensing an applicator liquid 6 from a container 20 to an applicator 30 is disposed within the internal passageway 47 of the closure 40.

FIGS. 7-13 illustrate the dispensing mechanism 10 of the liquid applicator device 5. The dispensing mechanism 10 includes a valve body 50, a valve element 60, a valve seal 70, a spring 80 and a tubular seal 90. The valve body 50 extends between a valve body inner end 51 and a valve body outer end 52. The valve body inner end 51 comprises a face having vents whereas the valve body outer end 52 comprises an opening. A cylindrical sidewall 53 extends between the valve body inner end 51 and the valve body outer end 52. A valve body shoulder 54 is formed on the valve body outer end 52 of the valve body 50. The valve body shoulder 54 is used for affixing the valve body 50 to the closure 40. A valve body spring retainer 56 extends from an inside surface of the inner end 51 for maintaining the position of the spring 80. A valve body projection 57 extends from the valve body outer end 52 of the valve body 50. The valve body projection 57 is used for affixing the valve body 50 to the valve seal 70. The valve body 50 is provided with a hole 59 defined within the valve body inner end 51 of the valve body 50. The hole 59 and vents on the inner end 51 of the valve body 50 facilitates the flow of the applicator liquid 6 from the container 20 into the valve body 50.

The valve element 60 extends between a valve element inner end 61 and a valve element outer end 62. The valve element 60 defines a circumferential sidewall 64. A valve element spring retainer 66 extends from the valve element inner end 61 of the valve element 60. The valve element spring retainer 66 receives a second end 82 of the spring 80.

The circumferential sidewall 64 of the valve element 60 supports a flared peripheral shoulder 68. The outside diameter of the flared peripheral shoulder 68 is less than the inner diameter of the valve body 50 for enabling the valve element 60 to move within the valve body 50.

The valve seal 70 includes a valve seal inner end 71 and a valve seal outer end 72 with a cylindrical sidewall 73 extending therebetween. The cylindrical sidewall 73 is provided with a valve seal shoulder 74. The valve seal shoulder 74 is shown as a circumferential shoulder having a diameter greater than the remainder of the cylindrical sidewall 73 of the valve seal 70. The valve seal shoulder 74 has a diameter substantially the same diameter as the diameter of the valve body shoulder 54 of the valve body 50. The valve seal 70 includes a valve seal annular bulge 76 extending about an outer surface of the cylindrical sidewall 73. The valve seal annular bulge 76 cooperates with the valve body hollow 56 of the valve body 50 for affixing the valve body 50 to the valve seal 70.

The valve seal 70 is press fit into the valve body 50 with the valve element 60 and the spring 80 located therebetween. The valve seal shoulder 74 limits the depth of penetration of the valve seal 70 into the valve body 50. The valve body hollow 56 of the valve body 50 receives the valve seal annular bulge 76 of the valve seal 70 for interlocking the valve seal 70 within the valve body 50 to form the dispenser mechanism 10.

The outside diameter of the flared peripheral shoulder 68 of the valve element 60 is less than the inner diameter of the valve body 50 enabling the valve element 60 to move within the valve body 50. The outside diameter of the flared peripheral shoulder 68 of the valve element 60 is greater than the inner diameter of the valve seal inner end 71 of the valve seal 70 for enabling valve element 60 to form a seal with the valve seal 70.

Figure 11:
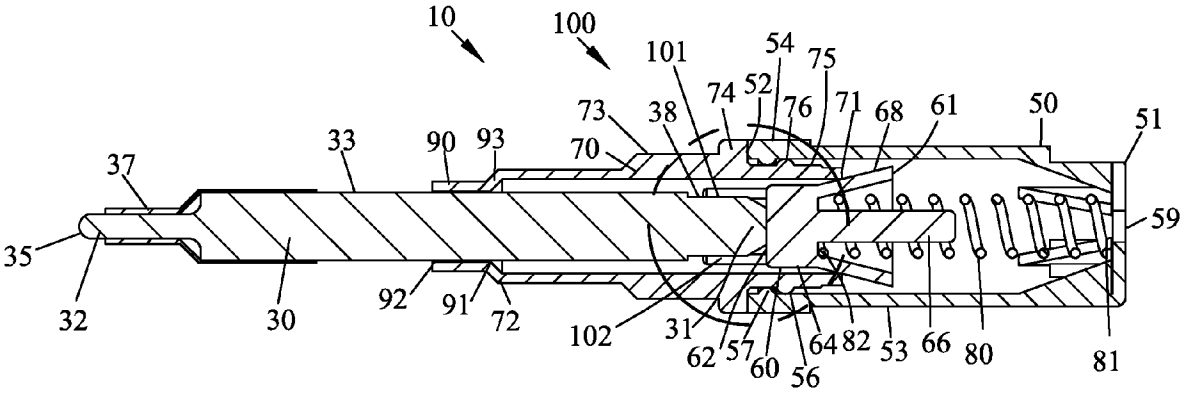
FIG. 11 is a sectional view along line 11-11 in FIG. 10.

The spring 80 biases the dispensing mechanism 10 in a closed condition as shown in FIG. 11. When the dispensing mechanism 10 in the closed condition, the flared peripheral shoulder 68 of the valve element 60 is biased by the spring 80 into engagement with the valve seal inner end 71 of the valve seal 70. The engagement of the flared peripheral shoulder 68 with the valve seal inner end 71 prevents the passage of the applicator liquid 6 from the container 20 to the applicator 30.

A tubular seal 90 extends between a tubular seal inner end 91 and a tubular seal outer end 92 as a one-piece molding. A mounting 93 integrally secures the tubular seal 90 to the valve seal outer end 72 of the valve seal 70. The tubular seal 90 provides a sliding seal with the applicator 30. The inner end 31 of the applicator tip 30 is in direct engagement with the outer end 62 of the valve element 60. The cylindrical diameter 33 of the applicator 20 forms a sliding seal with the tubular seal 90. The ferrule 37 forming a sliding relationship with the terminal orifice 48 of the closure 40.

Figure 12:
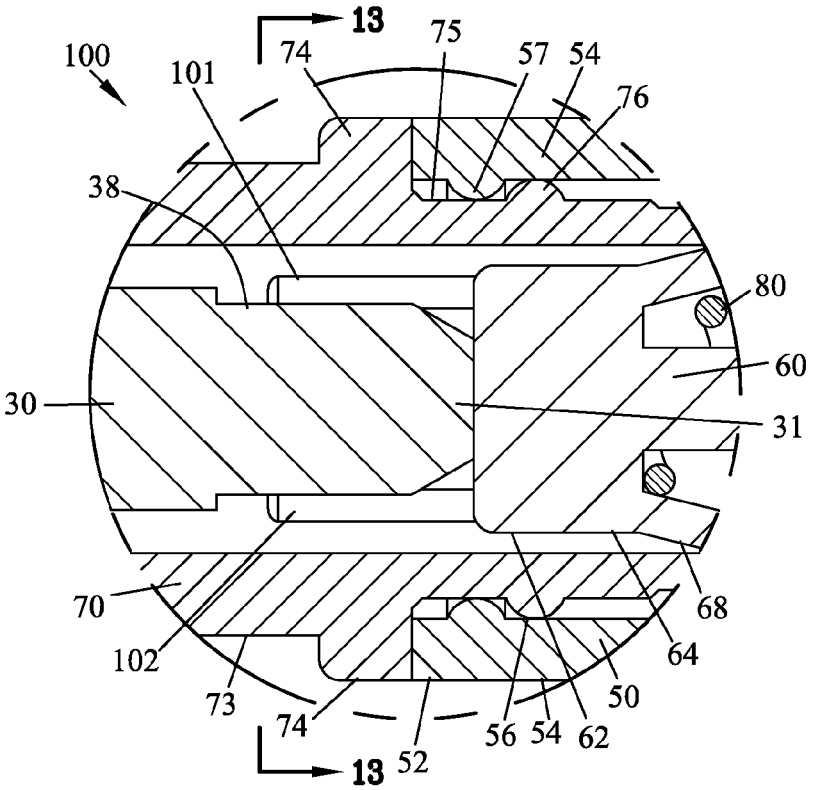
FIG. 12 is a magnified view of a portion of FIG. 11.
Figure 13:
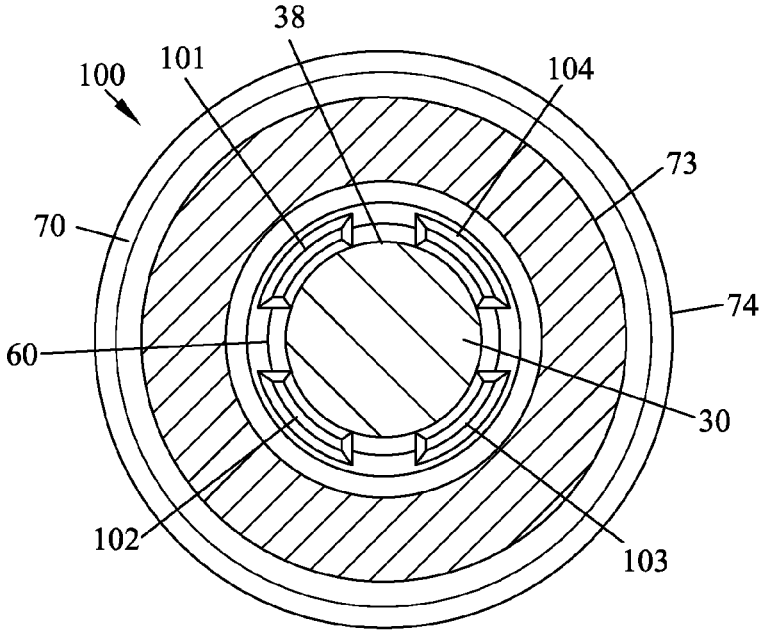
FIG. 13 is a sectional view along line 13-13 in FIG. 12.

FIGS. 12 and 13 illustrate an important aspect of the present invention. A capture 100 extends from the valve element 60 for grasping the applicator 30 for inhibiting removal of the applicator 30 from the passageway 47 of the closure 40. The capture comprises a plurality of resilient fingers 101-104 extending from the second end 62 of the valve element 60 for resiliently grasping the applicator 30. Preferably, the resilient fingers 101-104 are formed integrally with the valve element 60 from a polymeric material. In this embodiment, the first end 31 of the applicator 30 has a reduced cross-section 38. The plurality of resilient fingers 101-104 of the capture 100 resiliently grasps the reduced cross-section 38 of the applicator 30 for inhibiting removal of the applicator 30 from the valve element 60.

Figure 14:
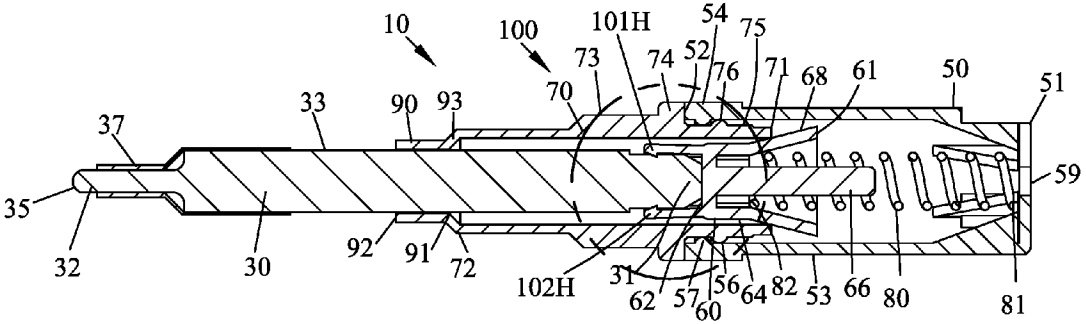
FIG. 14 is a side view of a second embodiment of the dispensing mechanism of the liquid applicator device of FIG. 1.
Figure 15:
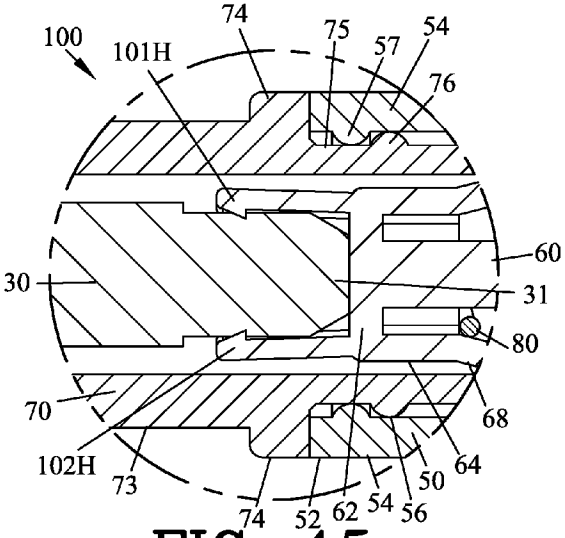
FIG. 15 is a magnified view of a portion of FIG. 14.

FIGS. 14-15 illustrate enlarged views of a second embodiment of the capture 100 for the dispensing mechanism 10 of the liquid applicator device 5. In this second embodiment, the capture 100 comprises a plurality of resilient fingers 101-104 extending from the valve element 60 with each of the resilient fingers 101-104 having an inward extending hook 101H-104H for resiliently grasping the applicator 30 to inhibit removal of the applicator 30 from the valve element 60.

Figure 16:
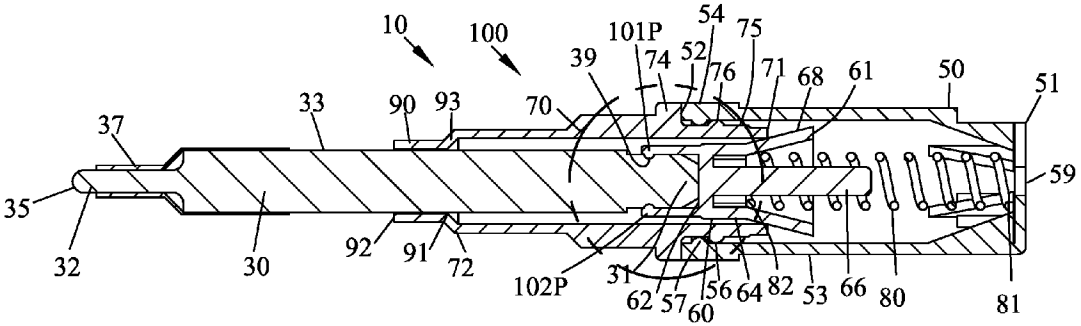
FIG. 16 is a side view of a third embodiment of the dispensing mechanism of the liquid applicator device of FIG. 1.
Figure 17:
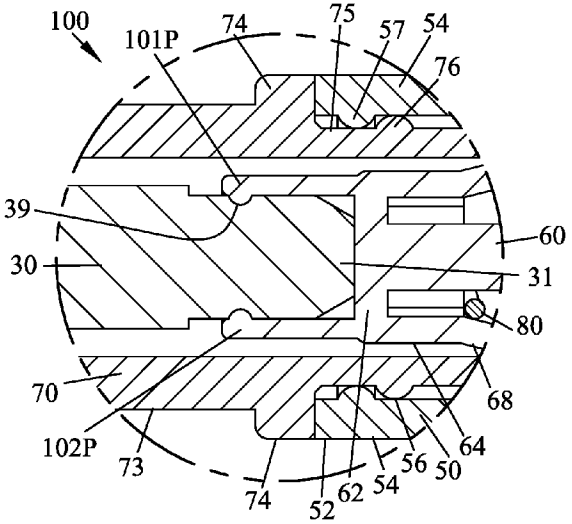
FIG. 17 is a magnified view of a portion of FIG. 16.

FIGS. 16-17 illustrate enlarged views of a third embodiment of the capture 100 for the dispensing mechanism 10 of the liquid applicator device 5. In this third embodiment, a groove 39 is defined in the reduced cross-section 38 of the first end 31 of the applicator 30. The capture 100 comprises a plurality of resilient fingers 101-104 extending from the valve element 60 with each of the resilient fingers 101-104 having an inward protrusion 101P-104P for resiliently engaging with the groove 39 to inhibit removal of the applicator 30 from the valve element 60.

The capture 100 may be incorporated into a single annular pocket, two resilient fingers 101-102 or any multitude of fingers. The use of the resilient fingers 101-104 separated by spaces enhances the flow of the applicator liquid 6 to the applicator 30.

The dispensing mechanism 10 comprising the valve body 50 and the valve seal 70 is secured within the internal passageway 47 of the closure 40. The valve body shoulder 54 and the valve seal shoulder 74 are maintained in contact when the valve seal annular bulge 76 is received within the valve body hollow 56 to affix the valve body 50 to the valve seal 70. The valve body shoulder 54 and the valve seal shoulder 74 are held in place within the internal passageway 47 of the closure 40 between a closure inner shoulder 49 and an inward extending keeper 79.

Figure 18:
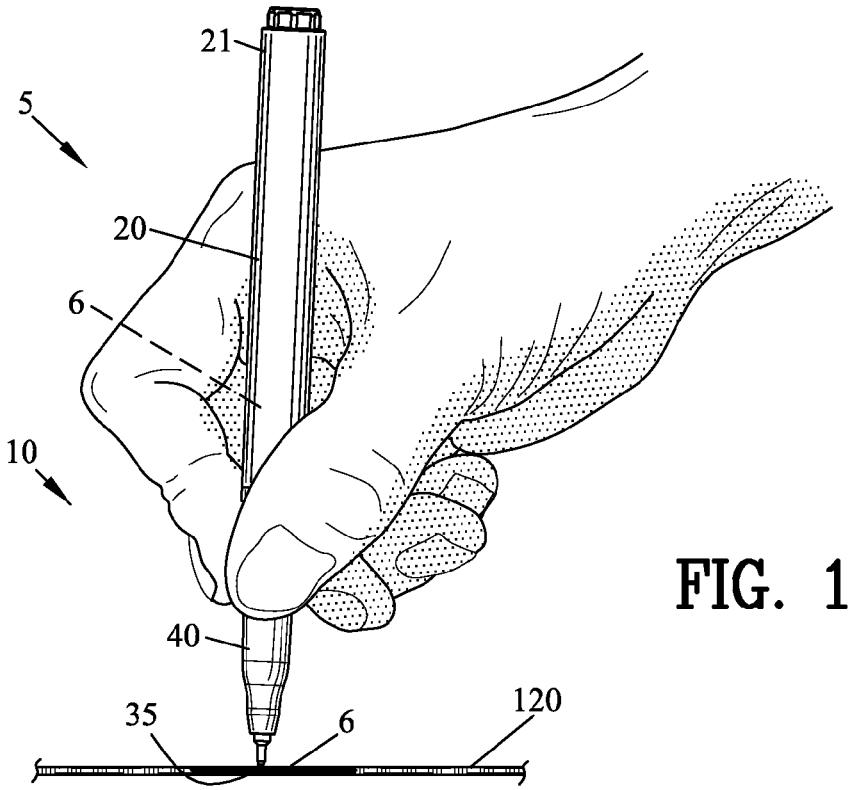
FIG. 18 illustrates the liquid applicator device of the present invention positioned over a surface.
Figure 20:
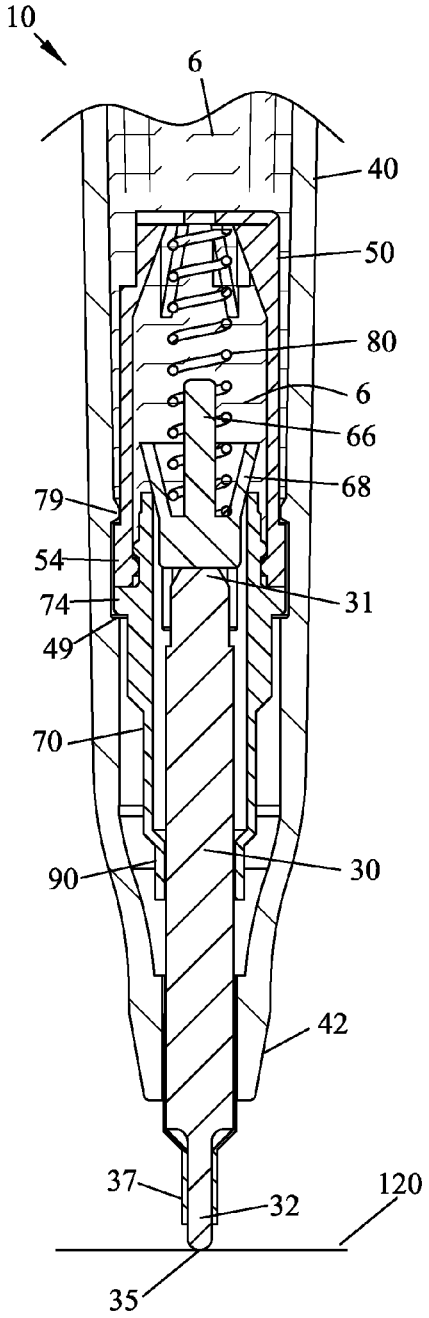
FIG. 20 is a sectional view illustrating the liquid applicator device in a closed position.

FIGS. 18 and 20 are views of the liquid applicator device 5 of the present invention shown in a closed position. The spring 80 urges the flared peripheral shoulder 68 of the valve element 60 into engagement with the valve seal inner end 71 to inhibit the passage of the applicator liquid 6 from the container 20 to the inner end 31 of the applicator 30.

Figure 19:
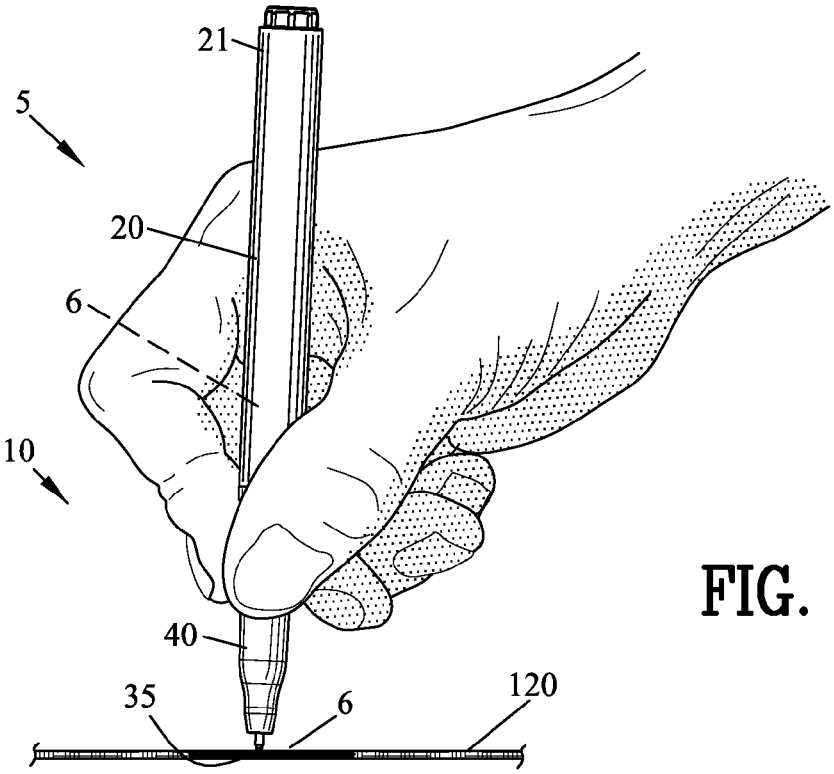
FIG. 19 illustrates the liquid applicator device of the present invention applying an applicator liquid to the surface upon depression of the applicator tip.
Figure 21:
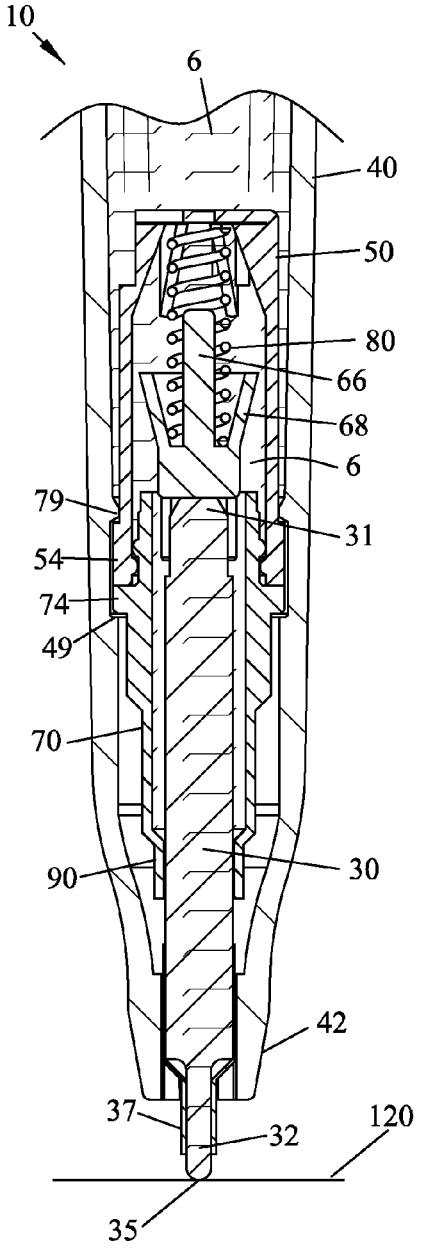
FIG. 21 is a sectional view illustrating the liquid applicator device in an open position.

FIGS. 19 and 21 are views of the liquid applicator device 5 of the present invention shown in an open position. A depression of the applicator tip 30 against a surface 120 will compress the spring 80 and move the flared peripheral shoulder 68 of the valve element 60 from the valve seal inner end 71 for enabling the passage of the applicator liquid 6 from the container 20 to contact the inner end 31 of the applicator 30. The applicator liquid 6 moves from the inner end 31 to the outer end 32 of the applicator tip 35 by capillary action. The applicator liquid 6 at the applicator tip 35 may be transferred to a surface 120 by marking, dabbing or a brushing action.

The engagement of the cooperating container boss 28 and the closure boss 46 creates an enhanced seal and much higher interlock retention between the container 20 and the closure 40. Mechanical benefits of this system include the enhanced seal, the stronger retention/interlock of the assembly, simplified mold tooling, and the elimination of much larger parts interfaces and/or threads to create such a strong interlock. Product benefits include greatly reduced accessibility to the package contents, longer product shelf life resulting from the increased seal, improved end user safety due to better package integrity, and a system that can be assembled more rapidly and lends itself to less complex automation versus threaded systems.

The capture 100 allows improved retention of the applicator 30 and allows for full freedom of motion of the applicator device 5. Furthermore, the capture allows an end user to remove the applicator 30 and place a new applicator 30 into the capture without damage. The benefit of this improvement is to greatly reduce/eliminate the applicator 30 from easily falling out during production processes and product use. The capture 100 allows simplified quality control, better user experience, and faster production speeds/throughput with far fewer product failures.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A liquid applicator device for dispensing an applicator liquid from an applicator liquid container; comprising;

a closure having an internal passageway for sealing with the applicator liquid container;

a valve body disposed in said internal passageway of said closure;

a valve seal having a sealing surface secured to said valve body;

a valve element disposed within said closure;

a spring acting between said valve body and said valve element for biasing said valve element into sealing engagement with said sealing surface of said valve seal for inhibiting the flow of the applicator liquid from the applicator liquid container;

an applicator located in said passageway engaging with said valve element for enabling a depression of said applicator to displace said valve element from said sealing surface to enable the flow of the applicator liquid from the liquid container into said applicator; and a capture comprising a plurality of resilient fingers extending from said valve element for resiliently grasping said applicator for inhibiting removal of said applicator from said passageway.

2. A liquid applicator device for dispensing an applicator liquid as set forth in claim 1, wherein said sealing surface is an annular sealing surface.

3. A liquid applicator device for dispensing an applicator liquid as set forth in claim 1, wherein said sealing surface comprises a generally tubular member defining an annular sealing surface at a termination of said generally tubular member.

4. A liquid applicator device for dispensing an applicator liquid as set forth in claim 1, wherein said valve element defines a first and a second end; and said valve element having a generally conical surface descending from said first end of said valve element toward said second end of said valve element for forming a sealing engagement with said sealing surface of said valve seal.

5. A liquid applicator device for dispensing an applicator liquid from an applicator liquid container; comprising;

a closure having an internal passageway for sealing with the applicator liquid container;

a valve body disposed in said internal passageway of said closure;

a valve seal having a sealing surface secured to said valve body;

a valve element disposed within said closure;

a spring acting between said valve body and said valve element for biasing said valve element into sealing engagement with said sealing surface of said valve seal for inhibiting the flow of the applicator liquid from the applicator liquid container;

an applicator located in said passageway engaging with said valve element for enabling a depression of said applicator to displace said valve element from said sealing surface to enable the flow of the applicator liquid from the liquid container into said applicator;

a capture comprising a plurality of resilient fingers extending from said valve element; and hook disposed on each of said plurality of resilient fingers for resiliently grasping said applicator for inhibiting removal of said applicator from said passageway.

6. A liquid applicator device for dispensing an applicator liquid as set forth in claim 1, wherein said valve element defines a first and a second end;

said first end of said valve element having a valve element projection for positioning said spring relative to said valve element; and said capture extending from said second end of said valve element for grasping said applicator to inhibit removal of said applicator.

7. A liquid applicator device for dispensing an applicator liquid as set forth in claim 1, wherein said applicator defines a first and a second end; and said first end of said applicator having a reduced cross-section;

said capture resiliently grasping said reduced cross-section of said applicator for inhibiting removal of said applicator from said valve element.

8. A liquid applicator device for dispensing an applicator liquid as set forth in claim 1, wherein said applicator defines a first and a second end;

said first end of said applicator tip having a reduced cross-section;

a groove defined in said reduced cross-section of said first end of said applicator; and each of said resilient lingers having an inward protrusion for resiliently engaging with the groove to inhibit removal of the applicator from the valve element.

9. A liquid applicator device for dispensing an applicator liquid as set forth in claim 1, wherein said applicator defines a first and a second end; and said second end of said applicator having second reduced cross-section defining an applicator tip; and a ferrule for partially covering said second end of said applicator for providing mechanical strength to said applicator tip.

10. A liquid applicator device for dispensing an applicator as set forth in claim 1, wherein said applicator defines a first and a second end; and said second end of said applicator having second reduced cross-section defining a defining an applicator tip;

a ferrule for partially covering Said second end of said applicator tip including said second reduced cross-section for providing mechanical strength to said applicator tip; and said ferrule forming a sliding relationship with a terminal orifice of said closure.

11. A liquid applicator device for dispensing an applicator liquid as set forth in claim 1, wherein each of said plurality of resilient fingers resiliently engages a first reduced cross-section of said applicator.

12. A liquid applicator device for dispensing an applicator liquid as set forth in claim 1, wherein each of said plurality of resilient fingers has an inwardly projecting hook for resiliently engaging a first reduced cross-section of said applicator.

13. A liquid applicator device for dispensing an applicator liquid from an applicator liquid container; comprising;

a closure having an internal passageway for sealing with the applicator liquid container;

a valve body disposed in said internal passageway of said closure;

a valve seal having a sealing surface secured to said valve body;

a valve element disposed within said closure;

a spring acting between said valve body and said valve element for biasing, said valve element into sealing engagement with said sealing surface of said valve seal for inhibiting the flow of the applicator liquid from the applicator liquid container;

an applicator located in said passageway engaging with said valve element for enabling a depression of said applicator to displace said valve element from said sealing surface to enable the flow of the applicator liquid from the liquid container into said applicator;

a groove defined in said applicator; and a capture including a plurality of resilient fingers with each of said plurality of resilient fingers having an inwardly protrusion for resiliently engaging said groove of said applicator for inhibiting removal of said applicator tip from said passageway of said closure.

14. A liquid applicator device for dispensing an applicator liquid as set forth in claim 1, including a container defining an annular recess supporting a container boss extending outwardly from said annular recess;

said closure having an outer shoulder defining an undercut with a closure boss extending inwardly therefrom; and said closure being dimensioned for insertion into said container with said annular recess of said container being received within said undercut of said closure enabling said container boss and said closure boss to resiliently engage one another to lock said closure to said container.

* * * * *